US005565113A

United States Patent [19]

Hadimioglu et al.

[11] Patent Number: 5,565,113

[45] Date of Patent: Oct. 15, 1996

[54] LITHOGRAPHICALLY DEFINED EJECTION UNITS

[75] Inventors: Babur B. Hadimioglu, Mountain View; Calvin F. Quate, Stanford; Scott A. Elrod, Redwood City; Eric G. Rawson, Saratoga; Martin Lim, Union City, all of Calif.

[73] Assignee: Xerox Corporation, Stamford, Conn.

[21] Appl. No.: 245,323

[22] Filed: May 18, 1994

[51] Int. Cl.[6] ..... B44C 1/22

[52] U.S. Cl. ..... 216/2; 156/633.1; 156/644.1; 216/27; 216/33; 216/56

[58] Field of Search ..... 216/2, 27, 33, 216/41, 56; 156/633.1, 644.1, 651.1, 659.11; 347/46

[56] References Cited

U.S. PATENT DOCUMENTS

| | | | |
|---|---|---|---|
| 4,308,547 | 12/1981 | Lovelady et al. | 347/46 |
| 4,455,192 | 6/1984 | Tamai | 216/27 |
| 4,697,195 | 9/1987 | Quate et al. | 347/46 |
| 4,719,476 | 1/1988 | Elrod et al. | 347/46 |
| 4,719,480 | 1/1988 | Elrod et al. | 347/46 |
| 4,748,461 | 5/1988 | Elrod | 347/46 |
| 4,751,529 | 6/1988 | Elrod et al. | 347/46 |
| 4,751,530 | 6/1988 | Elrod et al. | 347/46 |
| 4,751,534 | 6/1988 | Elrod et al. | 347/46 |
| 4,797,693 | 1/1989 | Quate | 347/46 |
| 4,959,674 | 9/1990 | Khri-Yakub et al. | 347/46 |
| 5,028,937 | 7/1991 | Khuri-Yakub et al. | 347/46 |
| 5,040,003 | 8/1991 | Willis | 347/118 |
| 5,041,849 | 8/1991 | Quate et al. | 347/46 |
| 5,087,931 | 2/1992 | Rawson | 347/46 |
| 5,111,220 | 5/1992 | Hadimioglu et al. | 347/46 |
| 5,121,141 | 6/1992 | Hadimioglu et al. | 347/46 |
| 5,122,818 | 6/1992 | Elrod et al. | 347/46 |
| 5,142,307 | 8/1992 | Elrod et al. | 347/46 |
| 5,204,690 | 4/1993 | Lorenze et al. | 216/27 X |
| 5,216,451 | 6/1993 | Rawson et al. | 347/46 |

OTHER PUBLICATIONS

Morales, P.; Sperandei, M. New Method of Deposition of Biomolecules for Bioelectronic Purposes. Appl Phys. Lett., vol. 64, No. 8, 21 Feb. 1994. pp. 1042–1044.

*Primary Examiner*—William Powell

[57] ABSTRACT

A material deposition head having lithographically defined ejector units. Beneficially, each ejector unit includes a plurality of lithographically defined droplet ejectors. Furthermore, methods of fabricating such lithographically defined material deposition heads are also described.

3 Claims, 7 Drawing Sheets

LITHOGRAPHICALLY DEFINED EJECTION UNITS

The present invention relates to acoustic droplet ejectors.

BACKGROUND OF THE PRESENT INVENTION

Various ink printing technologies have been or are being developed. One such technology, referred to as acoustic ink printing (AIP), uses focused acoustic energy to eject droplets from the free surface of a marking fluid onto a recording medium. It has been found that the principles of AIP are also suitable for the ejection of materials other than marking fluids. Those other materials include mylar catalysts, such as used in fabricating flexible cables, molten solder, hot melt waxes, color filter materials, resists, and chemical and biological compounds.

In most applications an ejected droplet must be deposited upon a receiving medium in a predetermined, possibly controlled, fashion. For example, when color printing it is very important that an ejected droplet accurately mark the recording medium in a predetermined fashion so as to produce the desired visual effect. The need for accurate positioning of ejected droplets on a receiving medium makes it desirable to droplets of the different colors in the same pass of the printhead across the recording medium, otherwise slight variations between the relative positions of the droplet ejectors and the receiving medium, or changes in either of their characteristics or the characteristics of the path between them, can cause registration problems (misaligned droplets).

The application of color printing can be used to illustrate the need for accurate droplet registration. To produce a predetermined color on a recording medium using AIP, the proper amounts of a number of different color inks have to be deposited in relatively close proximity. Without accurate registration of the droplets of the different colors the perceived color is incorrect because of overlap of some droplets (which produces an incorrect color at the overlap) and exposure (noncoverage) of the underlying receiving medium (which adds another color, that of the receiving medium, to the mix). Another application where extremely accurate control of ejected droplets is important is when forming small samples of overlapping proteins. Without proper registration, the desired protein sample is not obtained. Because of the need expressed for accurate volume depositions (reference P. Morales and M. Sperandei, "New method of deposition of biomolecules for bioelectronic purposes," Appl Phys. Lett. 64, pp. 1042–1044 (particularly pp. 1043) 21 Feb. 1994), it should be noted that since acoustically ejected droplets have very small, but accurately controlled, volumes, that acoustic droplet ejectors are particularly useful for depositing proteins.

One common attribute of both color printing and protein experimentation is that more than one material is involved. Therefore, when using acoustic ejection for color printing, protein experimentation, or other applications where more than one material is being ejected, it is beneficial to use a material deposition head with multiple ejector units. By material ejection head it is meant a structure from which droplets of one or more materials are ejected. By "ejector unit" it is meant a structure capable of ejecting a selected material from an associated chamber which is either the only chamber, or is one that is isolated from the other chambers. Therefore, a material deposition head with multiple ejector units is a structure capable of ejecting multiple materials. In terms of color printing, a material deposition head with multiple ejector units is a printhead capable of holding and ejecting more than one color of ink.

In the prior art is the technique of abutting individual ejector units together to achieve a material ejection head with multiple ejector units. However, as the required droplet placement accuracy increases, as more ejector units having more individual droplet ejectors are required, and as low cost becomes more important, the abutting of individual ejector units to form a material ejection head with multiple ejector units becomes problematic.

Therefore, a material deposition head having a plurality of ejector units, each having a plurality of accurately located individual droplet ejectors, and which are accurately located relative to each other, is desirable. Furthermore, a technique for fabricating such a material deposition head having a plurality of ejector units, each having a plurality of accurately located individual droplet ejectors, and which are accurately located relative to each other, is also desirable. Beneficially, to achieve tight droplet registration at low cost such a material deposition head would have lithographically defined ejector units.

More detailed descriptions of acoustic droplet ejection and acoustic printing in general are found in the following U.S. Patents and in their citations: U.S. Pat. No. 4,308,547 by Lovelady et al., entitled "LIQUID DROP EMITTER," issued 29 Dec. 1981; U.S. Pat. No. 4,697,195 by Quate et al., entitled "NOZZLELESS LIQUID DROPLET EJECTORS," issued 29 Sep. 1987; U.S. Pat. No. 4,719,476 by Elrod et al., entitled "SPATIALLY ADDRESSING CAPILLARY WAVE DROPLET EJECTORS AND THE LIKE," issued 12 Jan. 1988; U.S. Pat. No. 4,719,480 by Elrod et al., entitled "SPATIAL STABLIZATION OF STANDING CAPILLARY SURFACE WAVES," issued 12 Jan. 1988; U.S. Pat. No. 4,748,461 by Elrod, entitled "CAPILLARY WAVE CONTROLLERS FOR NOZZLELESS DROPLET EJECTORS," issued 31 May 1988; U.S. Pat. No. 4,751,529 by Elrod et al., entitled "MICROLENSES FOR ACOUSTIC PRINTING," issued 14 Jun. 1988; U.S. Pat. No. 4,751,530 by Elrod et al., entitled "ACOUSTIC LENS ARRAYS FOR INK PRINTING," issued 14 Jun. 1988; U.S. Pat. No. 4,751,534 by Elrod et al., entitled "PLANARIZED PRINTHEADS FOR ACOUSTIC PRINTING," issued 14 Jun. 1988; U.S. Pat. No. 4,959,674 by Khri-Yakub et al., entitled "ACOUSTIC INK PRINTHEAD HAVING REFLECTION COATING FOR IMPROVED INK DROP EJECTION CONTROL," issued 25 Sep. 1990; U.S. Pat. No. 5,028,937 by Khuri-Yakub et al., entitled "PERFORATED MEMBRANES FOR LIQUID CONTRONLIN ACOUSTIC INK PRINTING," issued 2 Jul. 1991; U.S. Pat. No. 5,041,849 by Quate et al., entitled "MULTI-DISCRETE-PHASE FRESNEL ACOUSTIC LENSES AND THEIR APPLICATION TO ACOUSTIC INK PRINTING," issued 20 Aug. 1991; U.S. Pat. No. 5,087,931 by Rawson, entitled "PRESSURE-EQUALIZED INK TRANSPORT SYSTEM FOR ACOUSTIC INK PRINTERS," issued 11 Feb. 1992; U.S. Pat. No. 5,111,220 by Hadimioglu et al., entitled "FABRICATION OF INTEGRATED ACOUSTIC INK PRINTHEAD WITH LIQUID LEVEL CONTROL AND DEVICE THEREOF," issued 5 May 1992; U.S. Pat. No. 5,121,141 by Hadimioglu et al., entitled "ACOUSTIC INK PRINTHEAD WITH INTEGRATED LIQUID LEVEL CONTROL LAYER," issued 9 Jun. 1992; U.S. Pat. No. 5,122,818 by Elrod et al., entitled "ACOUSTIC INK PRINTERS HAVING REDUCED FORCUSING SENSITIVITY," issued 16 Jun. 1992; U.S. Pat. No. 5,142,307 by Elrod et al., entitled "VARIABLE ORIFICE CAPILLARY WAVE PRINTER," issued 25 Aug. 1992; and U.S. Pat. No. 5,216,451 by Rawson et al., entitled "SURFACE RIPPLE WAVE DIFFUSION IN APERTURED FREE INK SURFACE LEVEL CONTROLLERS FOR ACOUSTIC INK PRINTERS," issued 1 Jun. 1993. All of those patents are hereby incorporated by reference.

SUMMARY OF THE INVENTION

In accordance with the present invention there is provided a material deposition head with lithographically defined ejector units. Beneficially, each ejector unit includes a plurality of lithographically defined droplet ejectors. Furthermore, methods of fabricating such lithographically defined material deposition heads are also provided.

BRIEF DESCRIPTION OF THE DRAWINGS

Other aspects of the present invention will become apparent as the following description proceeds and upon reference to the drawings, in which.

Figure 1:
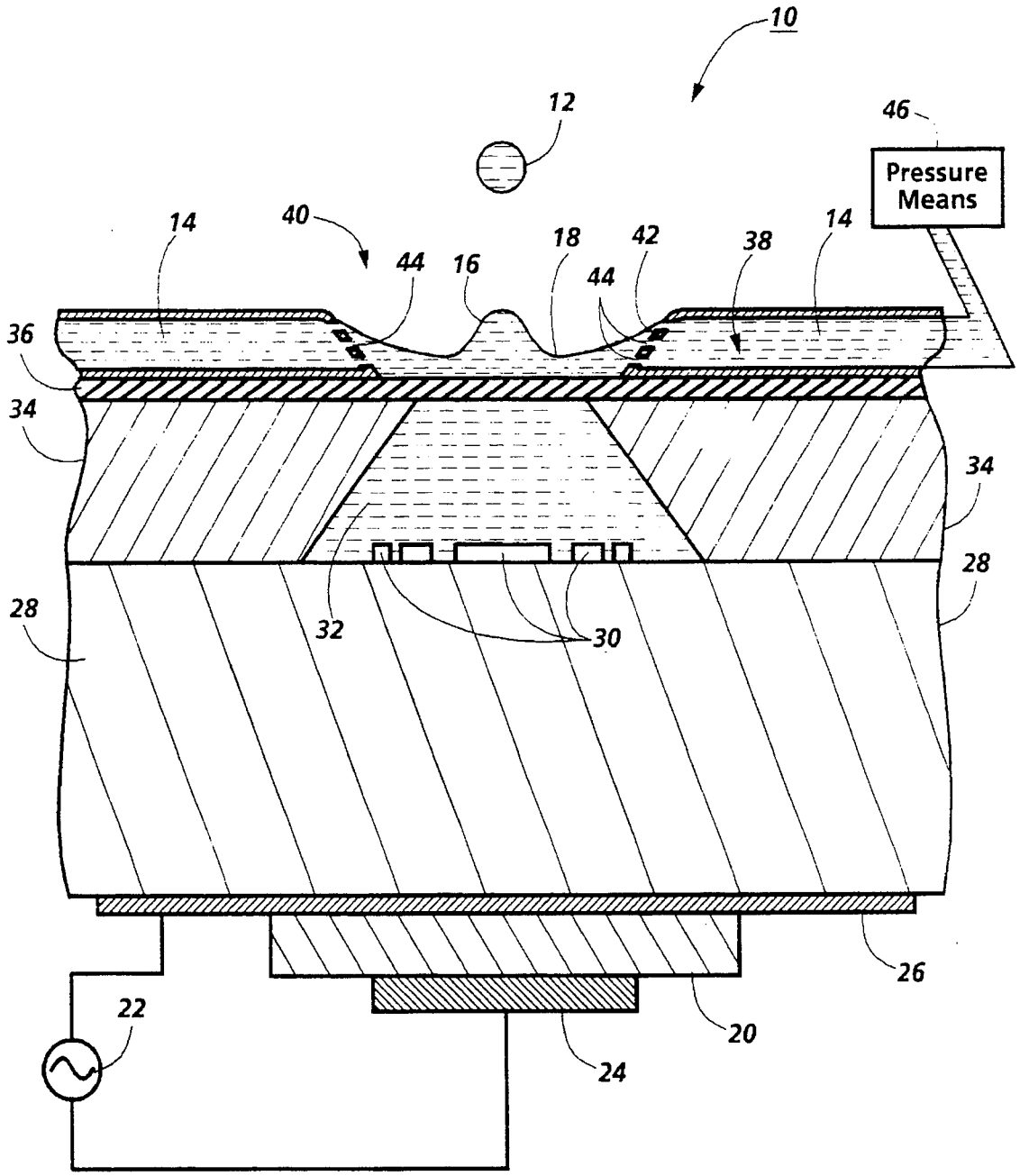
FIG. 1 is an unscaled, cross-sectional view of a first embodiment acoustic droplet ejector which is shown ejecting a droplet of a marking fluid.

Note that in the drawings, like numbers designate like elements. Additionally, the subsequent text uses various directional signals that are related to the drawings (such as right, left, up, down, top, bottom, lower and upper). Those directional signals are meant to aid the understanding of the present invention, not to limit it.

DETAILED DESCRIPTION OF THE ILLUSTRATED EMBODIMENT

The principles of the present invention will become clearer after study of the commercially important embodiment of color acoustic printing. Refer now to FIG. 1 for an illustration of an exemplary acoustic droplet ejector 10. FIG. 1 shows the droplet ejector 10 shortly after ejection of a droplet 12 of marking fluid 14 and before the mound 16 on the free surface 18 of the marking fluid 14 has relaxed. As droplets are ejected from such mounds, mound relaxation and subsequent formation are prerequisites to the ejection of other droplets.

The forming of the mound 16 and the ejection of the droplet 12 are the results of pressure exerted by acoustic forces created by a ZnO transducer 20. To generate the acoustic pressure, RF drive energy is applied to the ZnO transducer 20 from an RF driver source 22 via a bottom electrode 24 and a top electrode 26. The acoustic energy from the transducer passes through a base 28 into an acoustic lens 30. The acoustic lens focuses its received acoustic energy into a small focal area which is at, or is near, the free surface 18 of the marking fluid 14. Provided the energy of the acoustic beam is sufficient and properly focused relative to the free surface 18 of the marking fluid, a mound 16 is formed and a droplet 12 is ejected.

Suitable acoustic lenses can be fabricated in many ways, for example, by first depositing a suitable thickness of an etchable material on the substrate. Then, the deposited material can be etched to create the lenses. Alternatively, a master mold can be pressed into the substrate at the location where the lenses are desired. By heating the substrate to its softening temperature acoustic lenses are created.

Still referring to FIG. 1, the acoustic energy from the acoustic lens 30 passes through a liquid cell 32 filled with a liquid (such as water) having a relatively low attenuation. The bottom of the liquid cell 32 is formed by the base 28, the sides of the liquid cell are formed by surfaces of an aperture in a top plate 34, and the top of the liquid cell is sealed by an acoustically thin capping structure 36. By "acoustically thin" it is implied that the thickness of the capping structure is less than the wavelength of the applied acoustic energy.

The droplet ejector 10 further includes a reservoir 38, located over the capping structure 36, which holds marking fluid 14. As shown in FIG. 1, the reservoir includes an opening 40 defined by sidewalls 42. It should be noted that the opening 40 is axially aligned with the liquid cell 32. The side walls 42 include a plurality of portholes 44 through which the marking fluid passes. A pressure means 46 forces marking fluid 14 through the portholes 44 so as to create a pool of marking fluid having a free surface over the capping structure 36.

The droplet ejector 10 is dimensioned such that the free surface 18 of the marking fluid is at, or is near, the acoustic focal area. Since the capping structure 36 is acoustically thin, the acoustic energy readily passes through the capping structure and into the overlaying marking fluid.

A droplet ejector similar to the droplet ejector 10, including the acoustically thin capping structure and reservoir, is described in U.S. patent application Ser. No. 890,211, filed by Quate et. al. on 29 May 1992, now abandon. That patent application is hereby incorporated by reference.

Figure 2:
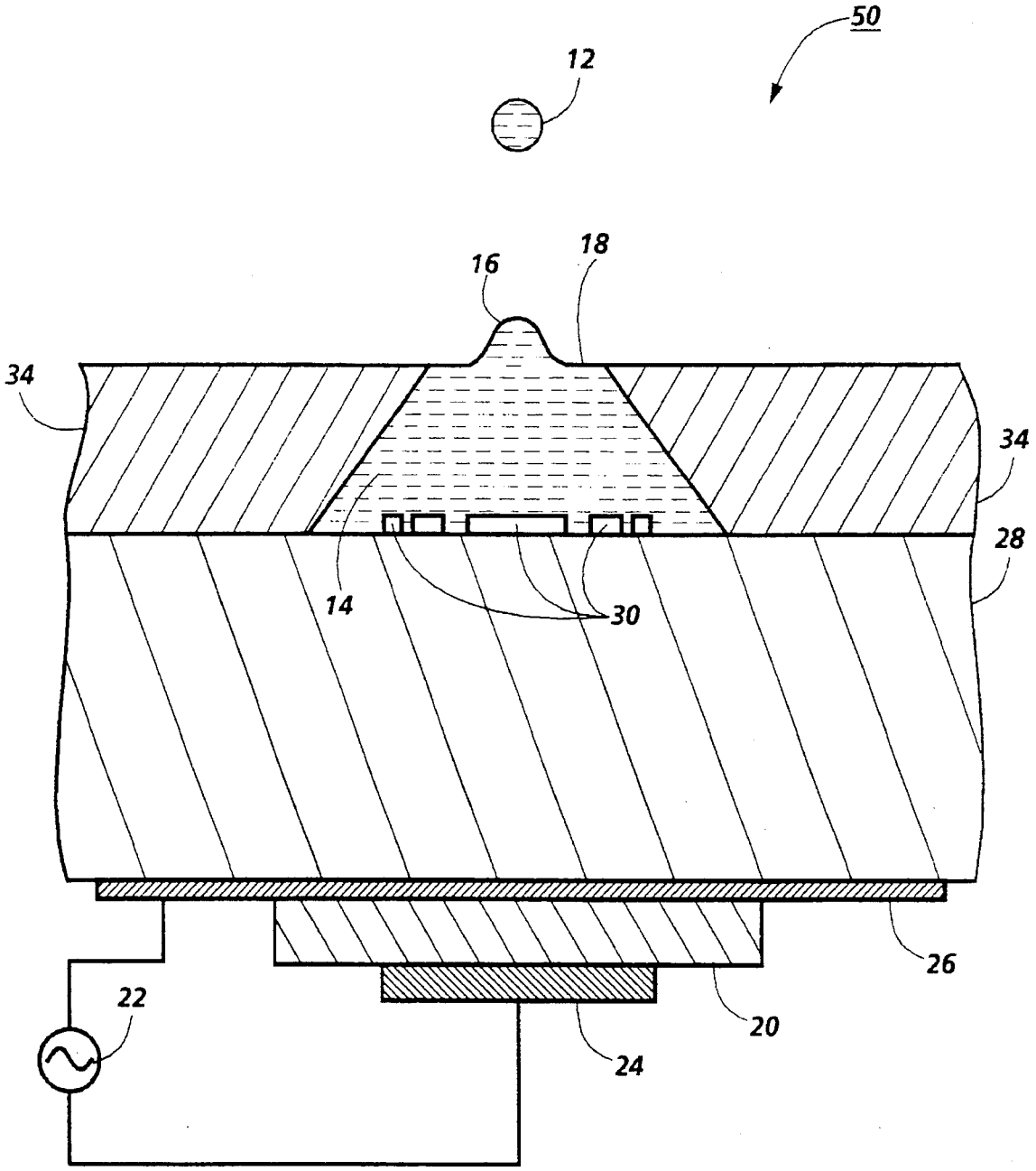
FIG. 2 is an unscaled cross-sectional view of a second embodiment acoustic droplet ejector which is shown ejecting a droplet of a marking fluid.

A second embodiment acoustic droplet ejector 50 is illustrated in FIG. 2. The droplet ejector 50 does not have a liquid cell 32 sealed by an acoustically thin capping structure 36. Nor does it have the reservoir filled with marking fluid 14 nor any of the elements associated with the reservoir. Rather, the acoustic energy passes from the acoustic lens 30 directly into marking fluid 14. However, droplets 12 are still ejected from mounds 16 formed on the free surface 18 of the marking fluid.

While the acoustic droplet ejector 50 is conceptually simpler than the acoustic droplet ejector 10, it should be noted that the longer path length through the marking fluid of the acoustic droplet ejector 50 might result in excessive acoustic attenuation and thus may require larger acoustic power for droplet ejection.

Figure 3:
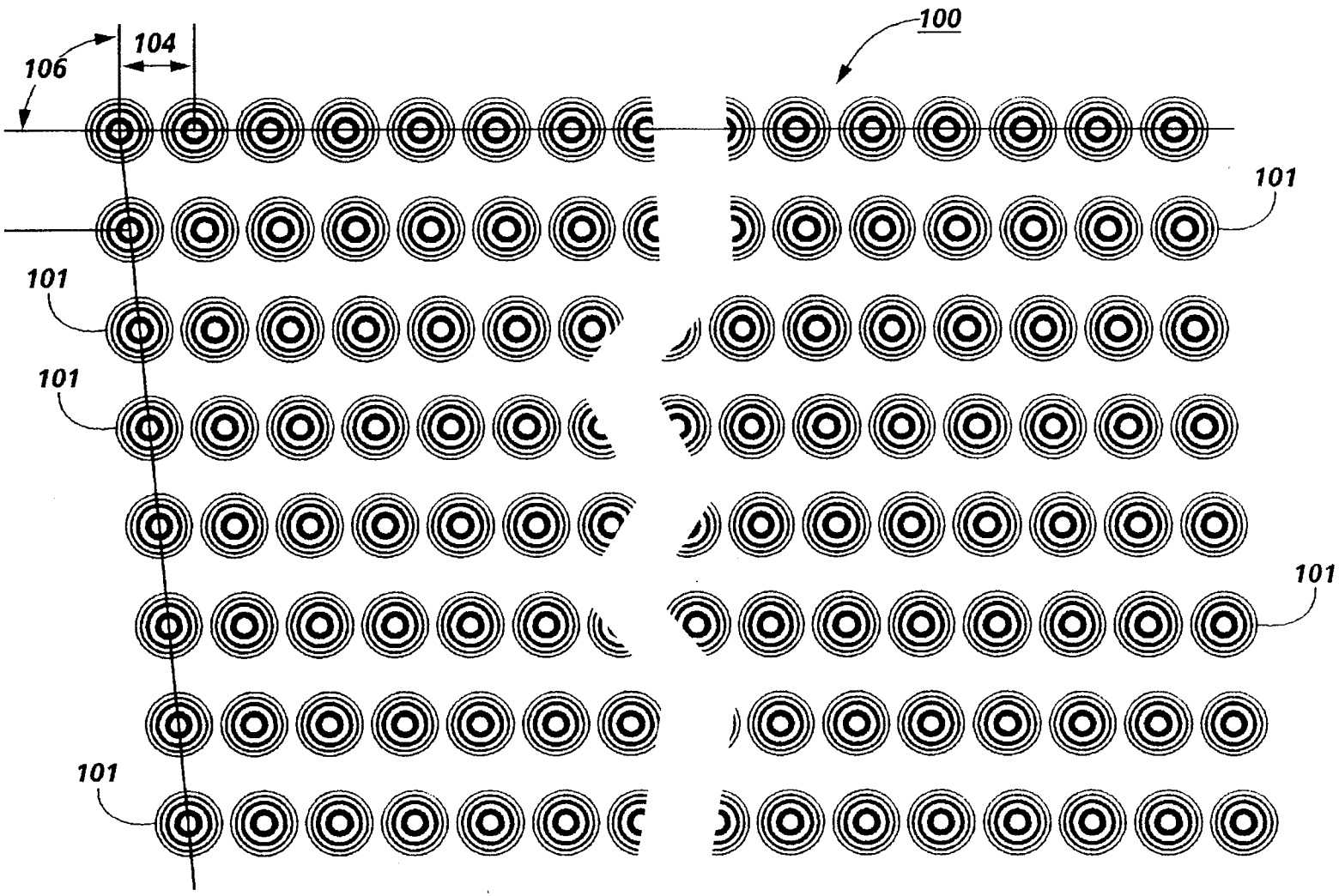
FIG. 3 is an top-down schematic depiction of an array of acoustic droplet ejectors in one ejector unit.

The individual acoustic droplet ejectors 10 and 50 (illustrated in FIGS. 1 and 2, respectively) are usually fabricated as part of an array of acoustic droplet ejectors. FIG. 3 shows a top-down schematic depiction of an array 100 of individual droplet ejectors 101 which is particularly useful in printing applications. Since each droplet ejector 101 is capable of ejecting a droplet with a smaller radius than the droplet ejector itself, and since full coverage of the recording medium is desired, the individual droplet ejectors are arrayed in offset rows. In FIG. 3, each droplet ejector in a given row is spaced a distance 104 from its neighbors. That distance 104 is eight (8) times the diameter of a droplet ejected from a droplet ejector. By offsetting eight (8) rows of droplet ejectors at an angle 106, and by moving the recording medium relative to the rows of droplet ejectors at a predetermined rate, the array 100 can print fully filled in (no gaps between pixels) lines or blocks.

Figure 4:
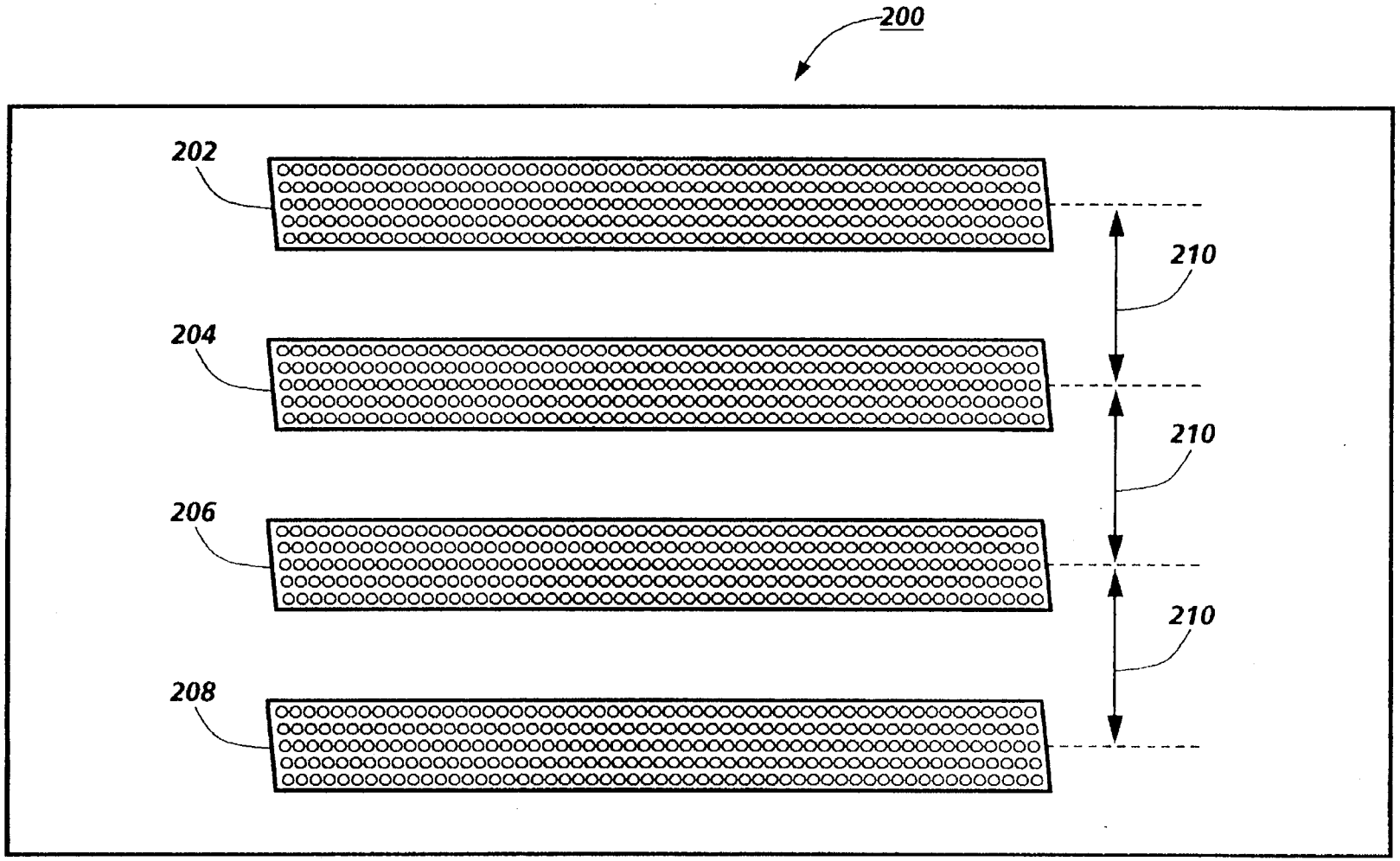
FIG. 4. is a top-down schematic view of the organization of a plurality of ejector units in a color printhead.

FIG. 3 illustrates an array of droplet ejectors capable of single pass printing of one color of marking fluid, i.e., one ejection unit. The present invention provides for lithographically defining multiple ejection units, each capable of ejecting a different material, in a single material deposition head. FIG. 4 schematically depicts a material deposition head 200 comprised of four arrays, designated arrays 202, 204, 206, and 208, each similar to the array 100 shown in FIG. 3 (except that, for clarity, only three rows of droplet ejectors are shown). Importantly, the separation 210 between each array is lithographically defined, and is thus accurately controllable. While in many applications the distance between each of the arrays will be the same, this is not required.

The benefit of a material deposition head such as material deposition head 200 is readily apparent. By forming multiple arrays, each capable of printing a different color, and by moving the recording medium relative to the material deposition head at a controlled rate, and by timing the ejection of each array correctly, color registration is readily achieved. Since the distance 210 is lithographically defined, tight color registration is possible. Since many applications besides color printing can benefit from the principles of the present invention, the subsequent text describes the present invention in terms of general applications.

Figure 5:
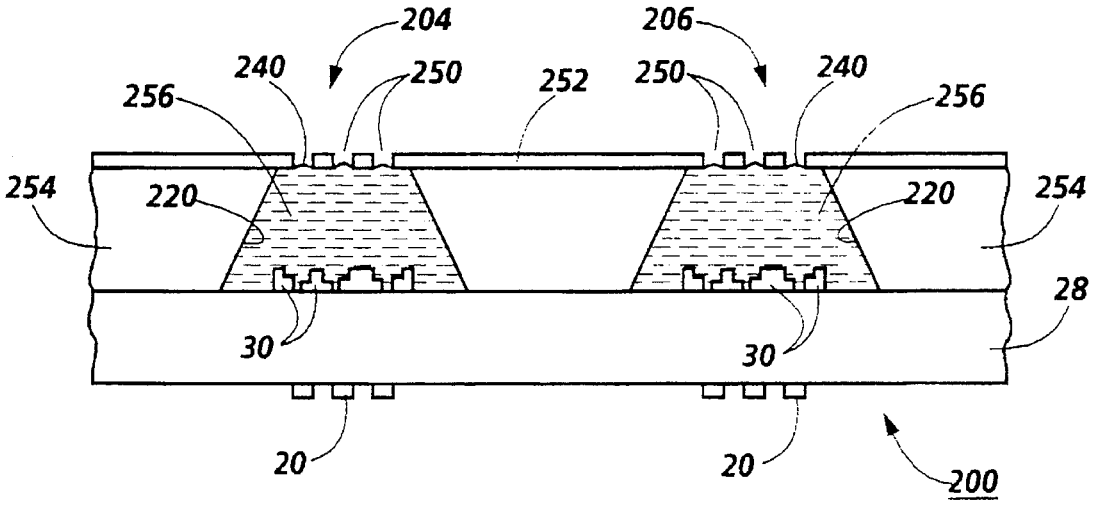
FIG. 5 is cross-sectional view of one embodiment of the present invention, a material deposition head having multiple ejection units.
Figure 6:
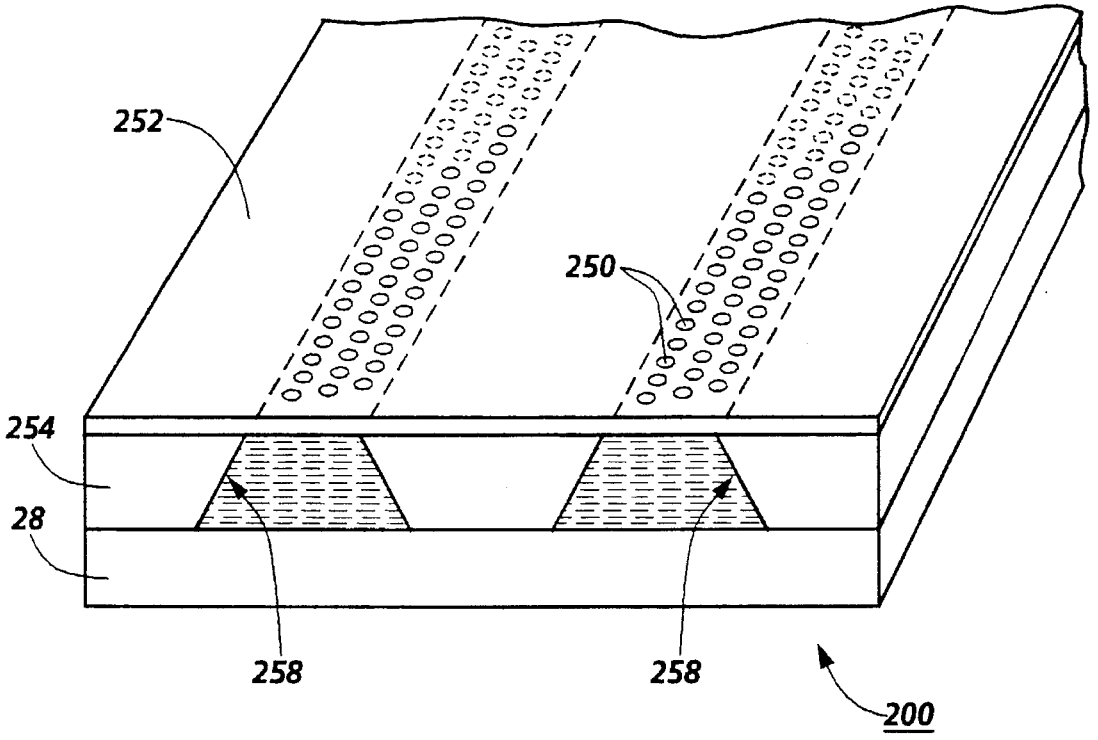
FIG. 6 is perspective view of the structure of FIG. 5.

A cross-sectional, simplified (again, only three rows of the eight rows of each ejection unit, and only two of the four ejection units) depiction of the material deposition head 200, with the arrays 204 and 206, is shown in FIG. 5. The other two arrays, the arrays 202 and 208, are not shown, but are understood as being off to the left and right, respectively. As shown,the free surface 240 of the material 256 is contained within apertures 250 that are defined in a thin plate 252 which is over a support 254. FIG. 6, a perspective view of FIG. 5, better illustrates the apertures 250. It is to be understood that each material 256 is confined in a chamber defined by a channel 258 and the base. The individual droplet ejectors each align with an associated aperture 250 which is axially aligned with that droplet ejector's acoustic lens 30 (see, also, FIGS. 1 and 2). Droplets are ejected from the free surface 240 through the apertures. The support 254 is directly bonded to a glass base 28.

It is to be noted that FIGS. 5 and 6 and the subsequent text and associated drawings all describe and illustrate individual droplet ejectors according to FIG. 2. It should be noted that droplet ejectors according to FIG. 1 are, in principle, also suitable for use in lithographically defined material deposition heads. However, referring now to FIG. 1, fabricating the reservoir and axially aligning it with the capping structure 36 and the lenses 30 is believed to be difficult to do. But in some applications the attenuation of the acoustic energy through the ejected material may be excessive, and thus the droplet ejectors of FIG. 1 may have to be used.

Figure 8:
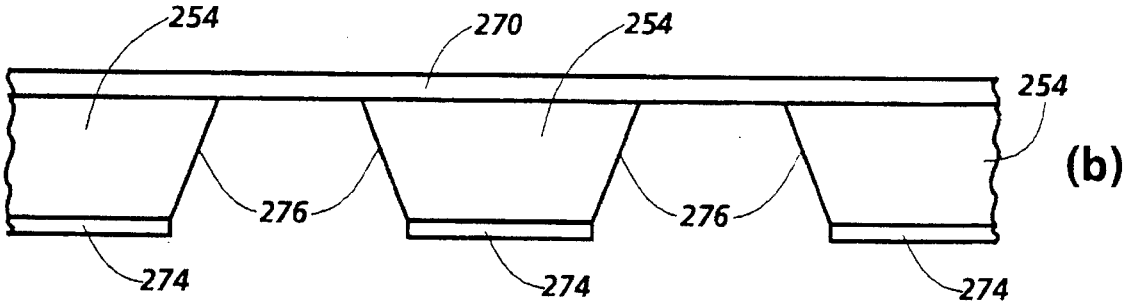
FIG. 8 is cross-sectional view of a structure existing subsequent to the structure of FIG. 7.
Figure 9:
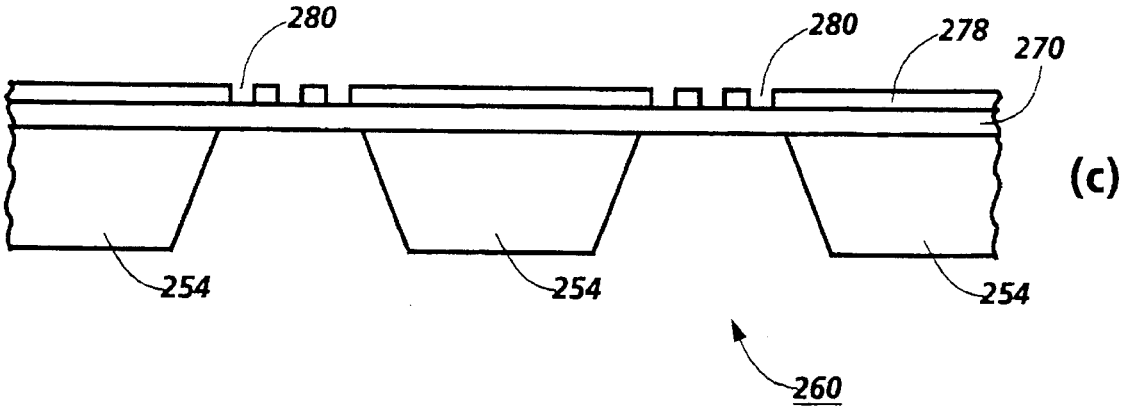
FIG. 9 is cross-sectional view of a structure that exists subsequent to the structure of FIG. 8.
Figure 10:
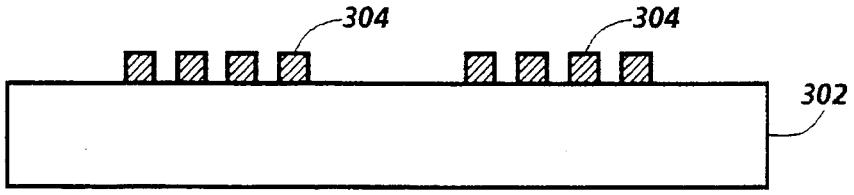
FIG. 10 is a cross-sectional view of a structure that exists early in a nickel plating process of fabricating the structure of FIGS. 5 and 6.
Figure 11:
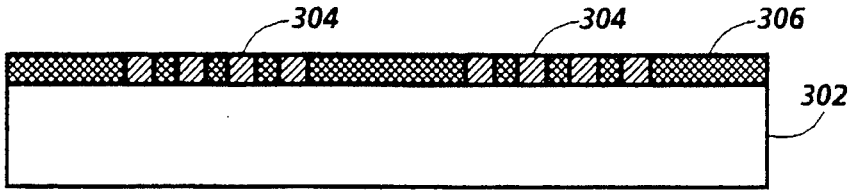
FIG. 11 is cross-sectional view of a structure existing subsequent to the structure of FIG. 10.
Figure 12:
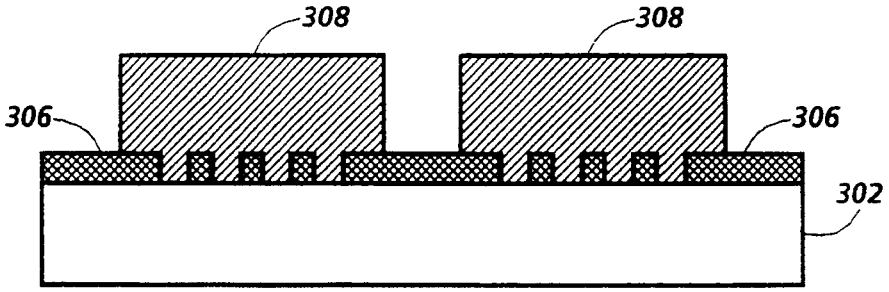
FIG. 12 is cross-sectional view of a structure that exists subsequent to the structure of FIG. 11.
Figure 13:
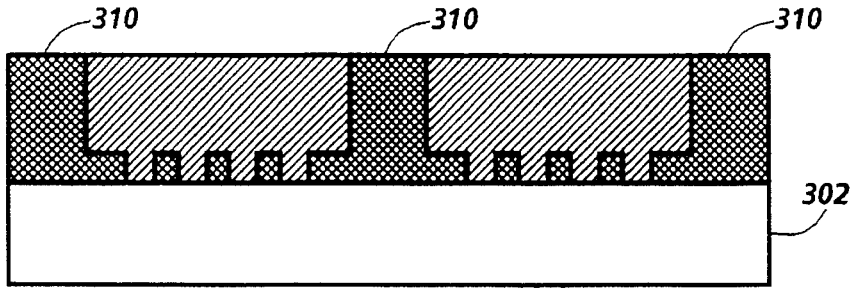
FIG. 13 is cross-sectional view of a structure existing subsequent to the structure of FIG. 12.
Figure 14:
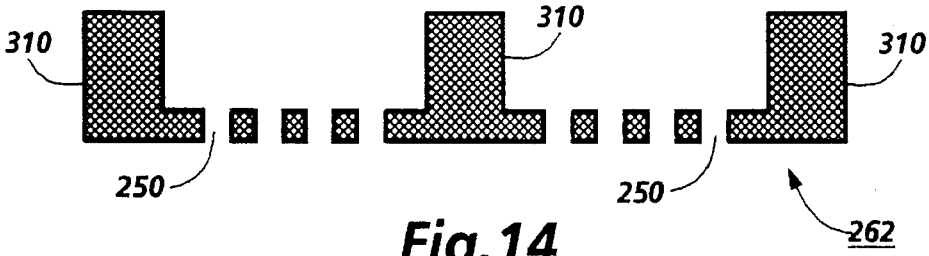
FIG. 14 is cross-sectional view of a structure that exists subsequent to the structure of FIG. 13.

The ejection units of the material deposition head 200 are beneficially lithographically defined and formed using conventional thin film processing (such as vacuum deposition, epitaxial growth, wet etching, dry etching, and plating). The fabrication of an ejection unit involves the fabrication of an aperture structure (see item 260 in FIGS. 9 and item 262 in FIG. 14) which includes the support 254 and which is bonded to the glass base 28. Details of the fabrication of the aperture structure 260 are described with the assistance of FIGS. 7 through 9. Details of the fabrication of the aperture structure 262 are described with the assistance of FIGS. 10 through 14.

Figure 7:
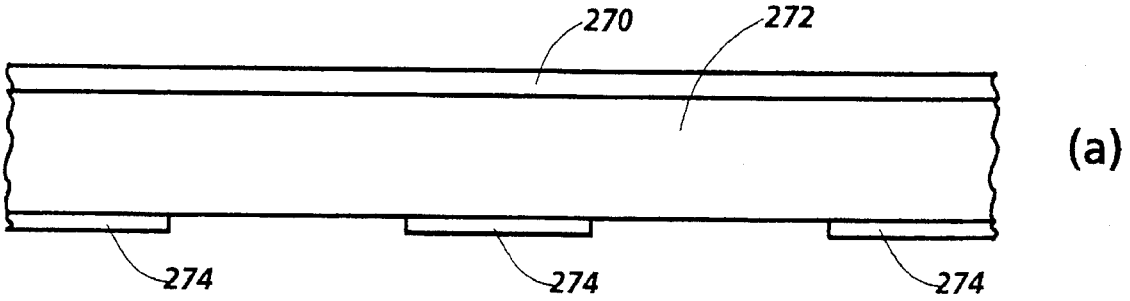
FIG. 7 is cross-sectional view of a structure that exists early in a process of fabricating the material deposition head shown in FIGS. 5 and 6.

Referring now to FIG. 7, to fabricate the aperture structure 260 a layer 270 of highly doped p-type epitaxial silicon is grown on a silicon substrate 272, which is either intrinsically or lightly doped. The side of the wafer which is opposite the layer 270 is then patterned with photoresist 274, see FIG. 7. The patterning 274 will define the fluid chambers for the individual ejection units. The structure of FIG. 7 is then anisotropically etched with KOH to define sloped surfaces 276 and the supports 254 (FIGS. 5 and 6), see FIG. 8. The patterned photoresist 274 is then removed and a layer of photoresist 278 is deposited over the layer 270. The photoresist layer 278 is then patterned and etched to define openings 280 through the photoresist layer, see FIG. 9. Those openings define the size and the locations of the apertures 250. The resulting structure is then etched, using a suitable etching technique, through the openings to create the apertures. The photoresist layer 278 is then removed and the aperture structure 260 is then bonded to a glass base 28.

The material deposition head 200 can also be fabricated using nickel plating. Nickel plating permits large material deposition heads to be fabricated (silicon-based material deposition heads fabricated using the method taught above are limited to the size of available silicon wafers). A nickel plating fabrication process is explained with reference to the cross-sectional views of FIGS. 10 through 14. First, protrusions 304 of photoresist are formed by depositing a masking layer of photoresist on a suitable mandrel 302, patterning, and then etching away the unwanted photoresist using standard techniques, see FIG. 10. The protrusions represents the apertures 250 (see FIGS. 5 and 6). Nickel 306 is then electroplated over the mandrel, except where the protrusions 304 are located, see FIG. 11. A second photoresist layer 308 is then deposited over the protrusions and over sections of the nickel 306. The layers 308 represent the locations of the fluid chambers for the individual ejection units, FIG. 12. A second plating process then adds more nickel to the exposed nickel surfaces of FIG. 12 to form nickel walls 310, see FIG. 13. The nickel walls correspond to the supports 254 of FIGS. 5 and 6. The photoresist layers from both patternings (layers 304 and 308) are then dissolved, leaving the aperture structure 262 (comprised of the nickel walls 310 and a nickel surface with apertures 250) and the mandrel 302. The aperture structure is then released from the mandrel 302, inverted, and then bonded to a glass base 28.

From the foregoing, numerous modifications and variations of the principles of the present invention will be obvious to those skilled in its art. For example, material deposition heads may also be fabricated by molding liquid channels in a suitable material (such as glass) or by fabricating using electric discharge machining. Therefore the scope of the present invention is to be defined by the appended claims.

What is claimed:

1. A method of fabricating a material deposition head comprised of the steps of:

(a) lithographically defining the locations of a plurality of channels;

(b) lithographically defining a plurality of apertures in each of the channels;

(c) fabricating an aperture structure having a plurality of channels and a plurality of openings in each of the channels; and (d) attaching the fabricated aperture structure to a base containing a plurality of droplet ejectors such that a plurality of fluid chambers are formed by the base and the channels, and such that a plurality of droplet ejectors are within each of the fluid chambers and axially aligned with the apertures.

2. The method of claim 1, wherein the steps (a), (b), and (c) are performed by the steps of;

(c) forming a layer of doped semiconductor material on a first surface of a substrate;

(f) depositing a first layer of resist on a second surface of the substrate;

(g) lithographically defining patterns in the first layer of resist which correspond to the locations and dimensions of the plurality of channels;

(h) removing section of the resist to enable etching of the substrate to define the plurality of channels;

(i) etching the substrate to define the plurality of channels;

(j) depositing a second layer of resist on the layer of doped semiconductor material;

(k) lithographically defining patterns in the second layer of resist which correspond to the locations and dimensions of the plurality of apertures;

(l) removing sections of the second layer of resist to enable etching of the semiconductor layer to form the plurality of apertures; and (m) etching the semiconductor layer to form the plurality of apertures.

3. The method of claim 1, wherein the steps (a), (b), and (c) are performed by the steps of, (n) depositing a first layer of resist on a suitable mandrel;

(o) lithographically defining patterns in the first layer of resist which correspond to the location and dimensions of the apertures;

(p) removing sections of the first layer Of resist to enable plating of the mandrel except where the apertures are to be located;

(q) plating over the exposed portions of the mandrel to form a first plated layer;

(r) depositing a second resist layer over the remainder of the first resist layer and over the plating;

(s) lithographically defining patterns in the second resist layer which correspond to the location and dimensions of the channels;

(t) removing sections of the second resist layer except where the channels are to be formed to expose portions of the first plated layer;

(u) plating over the first plated layer to form walls; and (v) removing the remaining sections of the first and second resist layers to define channels and apertures.

* * * * *